US009321289B2

(12) United States Patent
Yoshii

(10) Patent No.: US 9,321,289 B2
(45) Date of Patent: Apr. 26, 2016

(54) PRINTING APPARATUS, PRINTING METHOD, AND COMPUTER READABLE MEDIUM

(71) Applicant: CASIO COMPUTER CO., LTD., Shibuya-ku, Tokyo (JP)

(72) Inventor: Masakazu Yoshii, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/852,476

(22) Filed: Sep. 11, 2015

(65) Prior Publication Data

US 2016/0082754 A1 Mar. 24, 2016

(30) Foreign Application Priority Data

Sep. 22, 2014 (JP) ..... 2014-192291

(51) Int. Cl.
*B41J 29/393* (2006.01)
*B41J 13/00* (2006.01)
*B41J 3/407* (2006.01)

(52) U.S. Cl.
CPC ..... *B41J 13/0009* (2013.01); *B41J 3/4075* (2013.01)

(58) Field of Classification Search
CPC ..... B41J 29/393; B41J 2/125; B41J 2/2146; B41J 2/14153; B41J 19/202; B41J 19/205; B41J 2/04506; B41J 2/04508
See application file for complete search history.

(56) References Cited

U.S. PATENT DOCUMENTS 8,058,831 B2 * 11/2011 Ishikawa ..... B41J 19/202 318/484
8,567,896 B2 * 10/2013 Ueshima ..... B41J 2/04501 347/14
8,998,365 B2 * 4/2015 Hasegawa ..... B41J 29/393 347/14

FOREIGN PATENT DOCUMENTS

JP 2555697 B2 11/1996
JP 11105351 A 4/1999
JP 2002120406 A 4/2002
JP 2003003365 A 1/2003
JP 2006098727 A 4/2006
JP 2014004798 A 1/2014

* cited by examiner

*Primary Examiner* — Lamson Nguyen
(74) *Attorney, Agent, or Firm* — Holtz, Holtz & Volek PC

(57) ABSTRACT

A printing apparatus is provided that minimizes trouble of preparation of printing and management burden on the user. The printing apparatus includes a controller that determines an aspect ratio of a printing pattern on a basis of data of an expansion and contraction rate of a continuous print medium to be expandable or contractible after printing, the expansion and contraction rate including a first expansion and contraction rate in a longitudinal direction and a second expansion and contraction rate in a width direction orthogonal to the longitudinal direction, and a printing unit that prints the printing pattern of the aspect ratio determined by the controller, on the print medium before expansion or contraction.

19 Claims, 12 Drawing Sheets

FIG. 5

EXPANSION AND CONTRACTION RATE TABLE

| | TAPE WIDTH (mm) | |
|---|---|---|
| | 18→12 (mm) | 18→9 (mm) |
| STRETCH RATE IN LONGITUDINAL DIRECTION (%) | 150 (%) | 200 (%) |
| CONTRACTION RATE IN WIDTH DIRECTION (%) | Approximately 66.7 (%) | 50 (%) |

PRINTING APPARATUS, PRINTING METHOD, AND COMPUTER READABLE MEDIUM

CROSS-REFERENCE TO RELATED APPLICATIONS

This application is based upon and claims the benefit of priority from the prior Japanese Patent Application No. 2014-192291, filed Sep. 22, 2014, the entire contents of which are incorporated herein by reference.

FIELD

The present disclosure relates to a printing apparatus, a printing method, and a computer readable medium.

BACKGROUND

Printing apparatuses that perform printing on a print medium such as a continuous tape have thus far been known.

Unexamined Japanese Patent Application Kokai Publication No. H11-105351 discloses a technique of printing letters on a tape in smaller font sizes by a printing apparatus configured to perform the printing on an elastic tape, taking into account that the tape is expanded in actual use after the printing.

In the case where a plurality of tapes of different tape widths are to be subjected to the printing, the user sets the tape of the desired tape width on the printing apparatus when performing the printing.

In this case, the user has to manage the plurality of tapes other than the one subjected to the printing, by tape width. In addition, the user has to replace the tape when the tape of another tape width is subjected to the printing. Further, since a plurality of tapes of different tape widths is prepared, there may be a case where, at the time of the printing, the tape of the desired tape width is unavailable.

Accordingly, when a plurality of tapes of different tape widths are to be used, the preparation for the printing is troublesome, for example owing to the need to replace the tape, and the burden of managing the availability of the tapes is imposed on the user.

SUMMARY

In an aspect, the present disclosure provides a printing apparatus including a controller that determines an aspect ratio of a printing pattern on a basis of data of an expansion and contraction rate of a continuous print medium to be expandable or contractible after printing on the print medium, the expansion and contraction rate including a first expansion and contraction rate corresponding to a ratio of the length of the print medium after expansion or contraction to the length of the print medium before the expansion or contraction in a longitudinal direction and a second expansion and contraction rate corresponding to a ratio of the length of the print medium after the expansion or contraction to the length of the print medium before the expansion or contraction in a width direction orthogonal to the longitudinal direction, and a printing unit that prints the printing pattern of the aspect ratio determined by the controller, on the print medium before the expansion or contraction.

In another aspect, the present disclosure provides a printing method including a controlling step including determining an aspect ratio of a printing pattern on a basis of data of an expansion and contraction rate of a continuous print medium to be expandable or contractible after printing on the print medium, the expansion and contraction rate including a first expansion and contraction rate corresponding to a ratio of the length of the print medium after expansion or contraction to the length of the print medium before the expansion or contraction in a longitudinal direction and a second expansion and contraction rate corresponding to a ratio of the length of the print medium after the expansion or contraction to the length of the print medium before the expansion or contraction in a width direction orthogonal to the longitudinal direction, and a printing step including printing the printing pattern of the aspect ratio determined by the controller, on the print medium before the expansion or contraction.

In still another aspect, the present disclosure provides a computer readable medium storing a printing program configured to cause a computer to determine an aspect ratio of a printing pattern on a basis of data of an expansion and contraction rate of a continuous print medium to be expandable or contractible after printing on the print medium, the expansion and contraction rate including a first expansion and contraction rate corresponding to a ratio of the length of the print medium after expansion or contraction to the length of the print medium before the expansion or contraction in a longitudinal direction and a second expansion and contraction rate corresponding to a ratio of the length of the print medium after the expansion or contraction to the length of the print medium before the expansion or contraction in a width direction orthogonal to the longitudinal direction; and print the printing pattern of the aspect ratio determined by the controller, on the print medium before the expansion or contraction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 5 is a drawing showing an example of an expansion and contraction rate table;

DETAILED DESCRIPTION

Hereafter, an embodiment of the present disclosure will be described with reference to the drawings.

The embodiment is based on, as example, a printing apparatus (tape printer) configured to perform printing on a stretchable tape as print medium.

Figure 1:
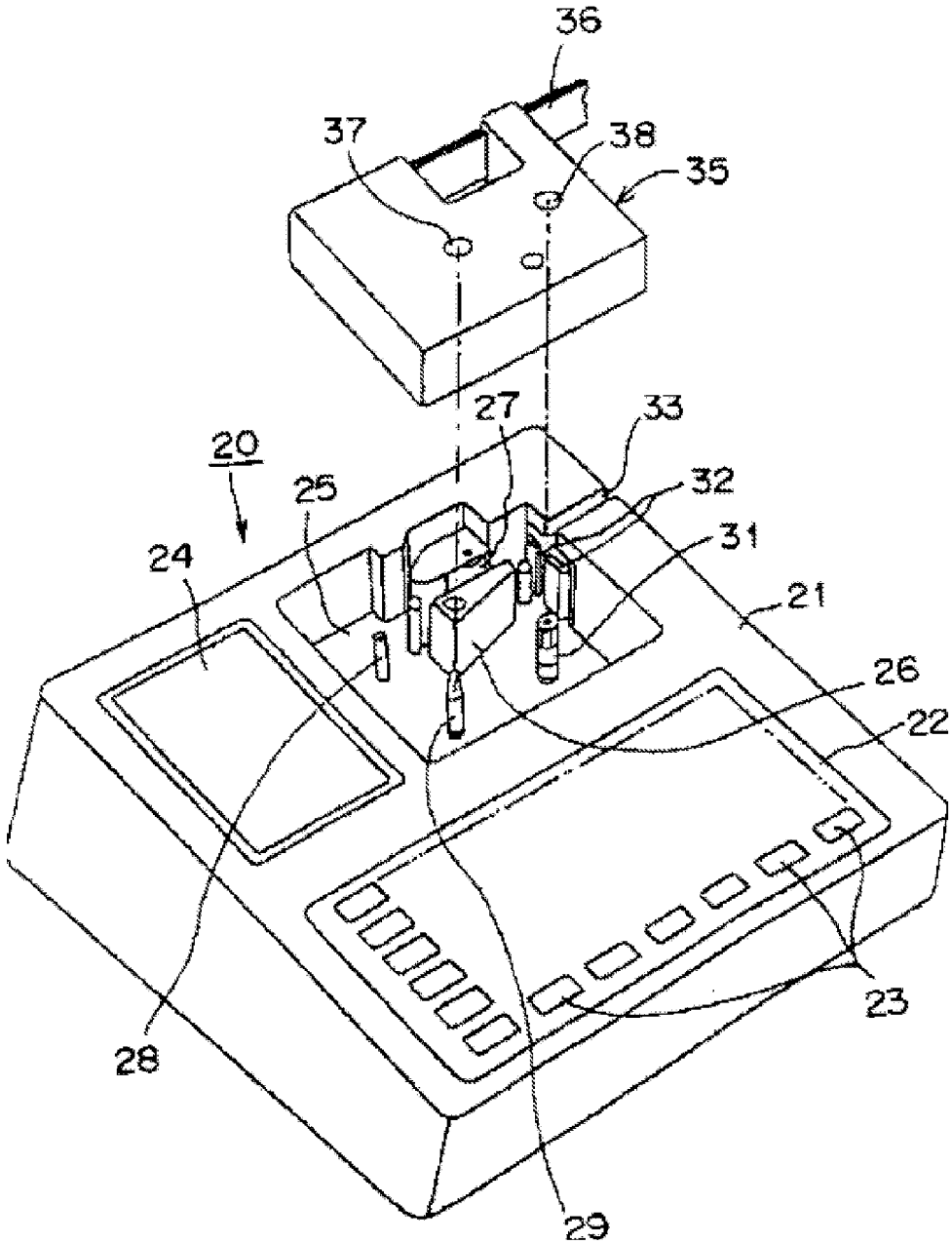
FIG. 1 is a perspective view of a printing apparatus according to an embodiment of the present disclosure.

FIG. 1 is a perspective view of the printing apparatus according to the embodiment of the present disclosure. FIG. 1 also illustrates, in an upper region of the drawing, a tape cassette 35 to be mounted in a printing apparatus 20.

As shown in FIG. 1, the printing apparatus 20 includes an input device 22 located in a lower portion of a casing 21, and a display 24 and a tape cassette chamber 25 located in an upper portion of the casing 21.

The input device 22 includes a plurality of operating keys 23, which are a print start key, a format setting key, a font size key, a pattern input key, and so forth.

The display 24 displays, for example, a pattern inputted by the user through the input device 22, and a menu screen for inputting various settings.

The tape cassette chamber 25 includes a thermal head 26 disposed so as to pivot up and downward, and a platen roller 27 opposed to the thermal head 26. In addition, a tape guide roller 28, tape reel support pin 29, an ink ribbon take-up drive shaft 31, and a tape cutter 32 are provided so as to surround the thermal head 26. A tape outlet 33 is provided on the right of the tape cutter 32.

When the tape cassette 35 is mounted in the tape cassette chamber 25, the tape reel support pin 29 is engaged with a tape reel hole 37 in the tape cassette 35 in which a tape 36 is wound, and the ink ribbon take-up drive shaft 31 is engaged with an ink ribbon take-up reel hole 38 in the tape cassette 35.

Figure 2:
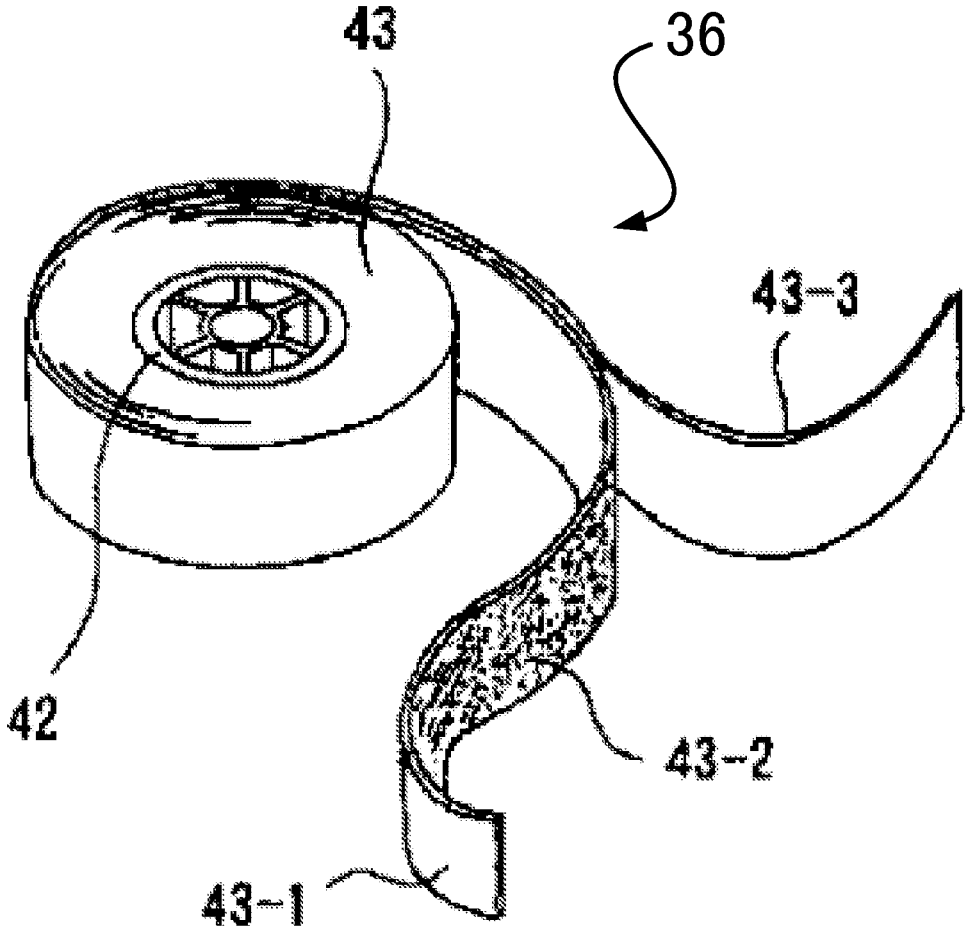
FIG. 2 is a perspective view showing a tape according to the embodiment of the present disclosure.

The tape 36 is an elastic continuous print medium, and is wound around a tape reel 42 as shown in FIG. 2. More specifically, the tape 36 includes an elastic printing surface layer 43-1, an adhesive layer 43-2 stuck to the back face of the printing surface layer 43-1, and a release paper 43-3 removably unified with the adhesive layer 43-2.

The printing surface layer 43-1 is formed of a soft resin film such as polyvinyl chloride (PVC), or a synthetic rubber. The release paper 43-3 is formed of a paper having a release agent applied to the surface to be stuck to the adhesive layer 43-2, and does not have elasticity from the viewpoint of transport.

Figure 3A:
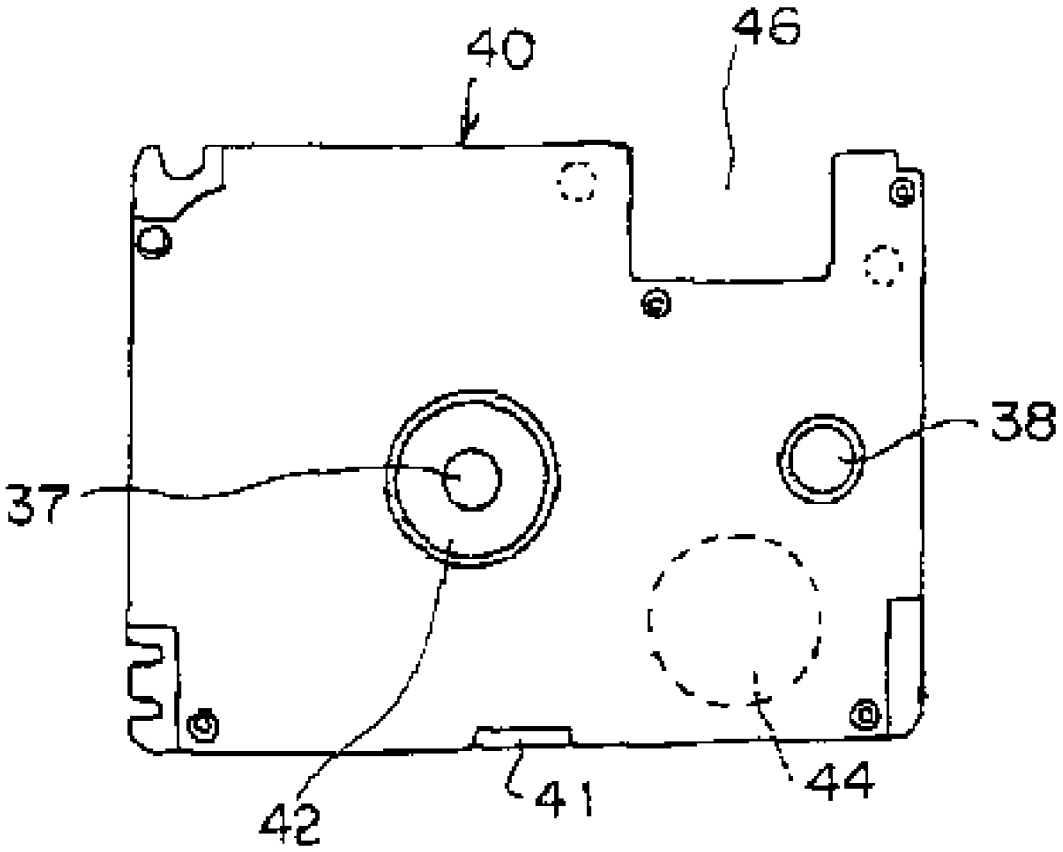
FIG. 3A is a plan view showing an outer appearance of a tape cassette in which the tape is set.
Figure 3B:
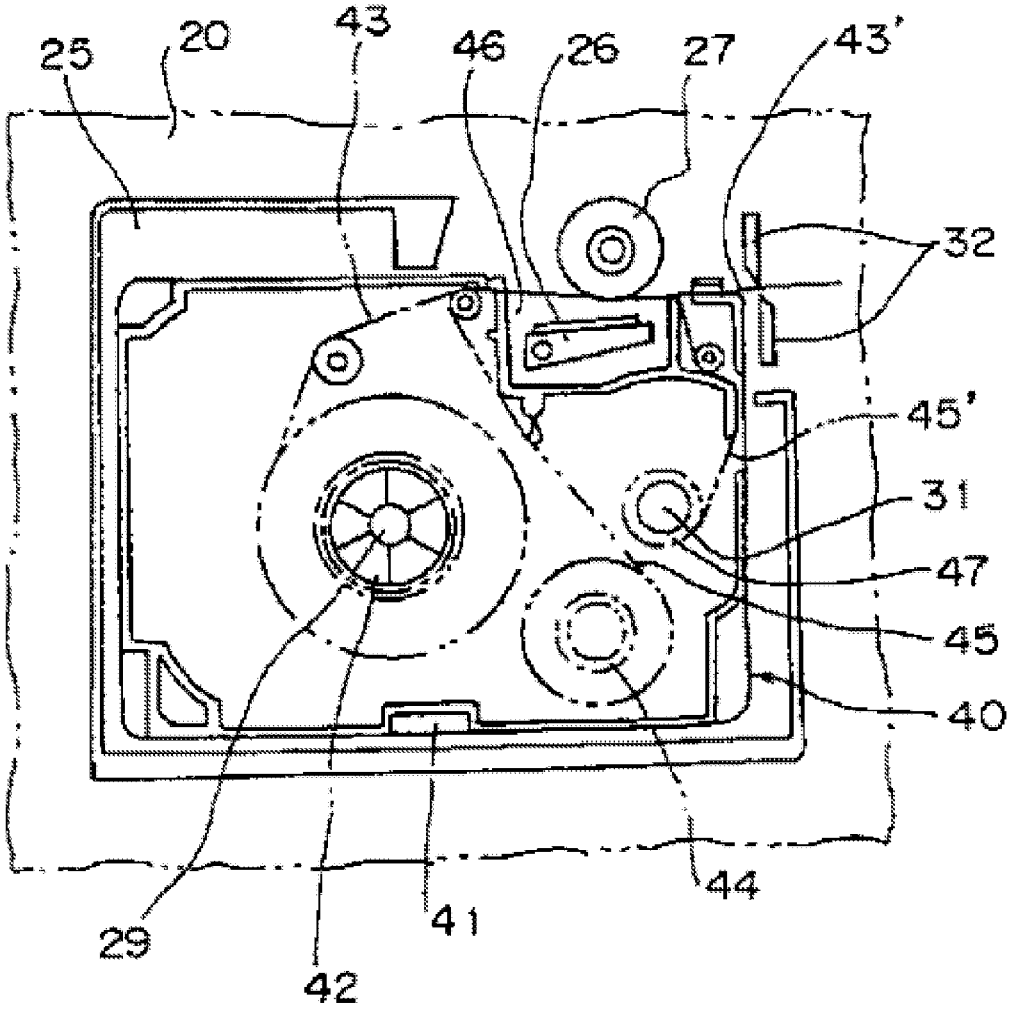
FIG. 3B is a cross-sectional view of the tape cassette mounted in a cassette chamber.

FIG. 3A is a plan view showing an outer appearance of the tape cassette 35 in which the tape 36 shown in FIG. 2 is set, and FIG. 3B is a cross-sectional view of the tape cassette 35 mounted in the cassette chamber 25.

As shown in FIG. 3A, the tape cassette 35 includes a cassette identification groove 41 indicating that the cassette includes the elastic tape 36, located at a predetermined position (central position in FIG. 3A) on the bottom portion of the tape cassette 35. The cassette identification groove 41 is detected by a groove detection sensor 90 to be subsequently described, when the tape cassette 35 is mounted in the tape cassette chamber 25 as shown in FIG. 3B.

The tape cassette 35 includes the tape 36 wound around the tape reel 42, and an ink ribbon 45 wound around an ink ribbon reel 44. The tape 36 and the ink ribbon 45 are superposed to each other and spanned over a recess 46 (see FIG. 3B) formed in an upper portion of the tape cassette 35.

When the printing is performed, the thermal head 26 is made to pivot toward the platen roller 27, and a heating element provided at the tip portion of the thermal head 26 is pressed against the platen roller 27 via the ink ribbon 45 and the tape 36, so that the ink on the ink ribbon 45 is thermally transferred to the printing surface layer 36-1 of the tape 36. After that, the ink ribbon 45 is taken up by an ink ribbon take-up reel 47. The tape 36 is discharged to outside through the tape outlet 33 (see FIG. 1), and cut off by the tape cutter 32. That is how the tape 36 is subjected to the printing process.

Figure 4:
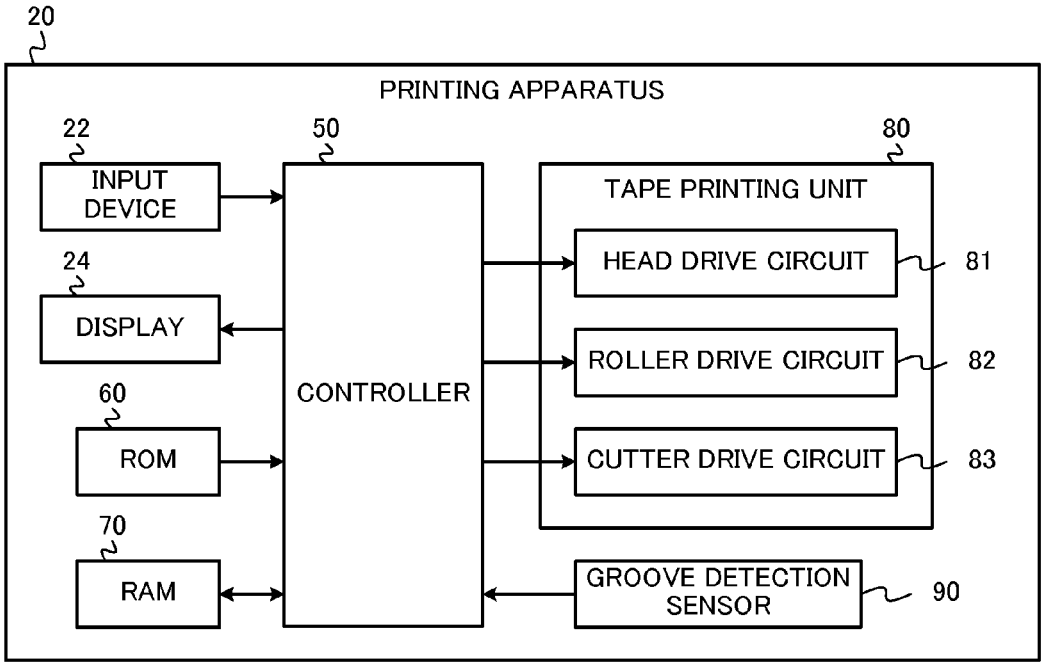
FIG. 4 is a block diagram showing a configuration of the printing apparatus according to the embodiment of the present disclosure.

Referring to FIG. 4, the block diagram of the printing apparatus 20 will be described.

The printing apparatus 20 includes a controller 50, the input device 22, the display 24, a Read Only Memory (ROM) 60, a random access memory (RAM) 70, a tape printing unit 80, and the groove detection sensor 90.

The controller 50 is constituted of, for example, a central processing unit (CPU). The controller 50 reads out from the ROM 60 a program related to printing control stored therein, and executes the program thereby acting as functional units to be subsequently described, such as an acquirer and a determiner.

The ROM 60 is a non-transitory storage device in which the programs related to the printing control and an expansion and contraction rate table shown in FIG. 5 are stored.

In the expansion and contraction rate table, the tape width (mm) of the tape 36 and the expansion and contraction rate of the tape 36 are associated with each other. The expansion and contraction rate refers to a ratio of the length after expansion to the length before the expansion. It will be assumed, as an example, that the tape 36 has a width of 18 mm before expansion, and an expansion and contraction rate in the longitudinal direction and an expansion and contraction rate in the width direction are reciprocal to each other (the area of the tape 36 remains unchanged between before and after expansion). In this embodiment, in addition, the expansion and contraction rate in the longitudinal direction and the expansion and contraction rate in the width direction, defined when the tape 36 is stretched in the longitudinal direction and contracted in the width direction, will be specifically referred to as stretch rate (first expansion and contraction rate) and a contraction rate (second expansion and contraction rate), respectively.

Figure 6A:
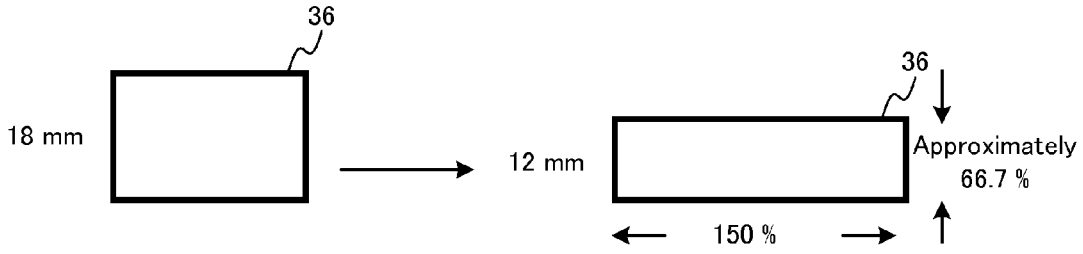
FIG. 6A is a drawing showing a stretch rate in a longitudinal direction and a contraction rate in a width direction, defined when the tape width is contracted from 18 mm before expansion to 12 mm after expansion.

In the example of the illustrated expansion and contraction rate table, when the tape width of the tape 36 contracted from 18 mm before expansion to 12 mm after expansion, the stretch rate in the longitudinal direction (horizontal direction) is 3/2 (150%), and the contraction rate in the width direction (vertical direction) is ⅔ (approximately 66.7%) (see FIG. 6A).

Figure 6B:
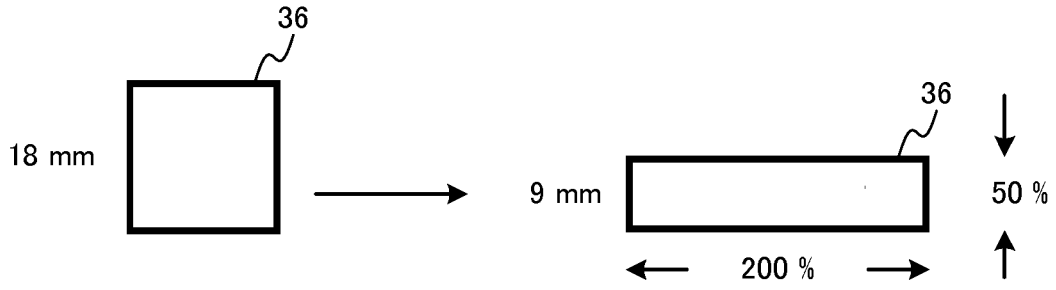
FIG. 6B is a drawing showing a stretch rate in the longitudinal direction and a contraction rate in the width direction, defined when the tape width is contracted from 18 mm before expansion to 9 mm after expansion.

In contrast, when the tape width of the tape 36 contracted from 18 mm before expansion to 9 mm after expansion, the stretch rate in the longitudinal direction (horizontal direction) is 2 (200%), and the contraction rate in the width direction (vertical direction) is ½ (50%) (see FIG. 6B).

The expansion and contraction rate table may be made up by the user by inputting in advance the expansion and contraction rates (stretch rates in the longitudinal direction and the contraction rates in the width direction) with respect to each of the tape widths after expansion. Alternatively, the user may input in advance the ratios between the stretch rate in the longitudinal direction and the contraction rate in the width direction, so that the printing apparatus automatically calculates the expansion and contraction rate (stretch rate in the longitudinal direction and contraction rate in the width direction) with respect to each of the tape widths after expansion (for example, 12 mm and 9 mm). For example, when the stretch rate in the longitudinal direction is represented by a (>1) and the contraction rate in the width direction is represented by $1/\alpha$ (<1), the ratio of the stretch rate in the longitudinal direction to the contraction rate in the width direction is $\alpha/(1/\alpha)=\alpha^2(>1)$, and therefore, when the ratio of the stretch rate in the longitudinal direction to the contraction rate in the width direction (>1) is inputted, the square root of the ratio (>1) may be automatically calculated as stretch rate in the longitudinal direction, and the reciprocal (<1) of the square root of the ratio may be automatically calculated as contraction rate in the width direction.

Referring back to FIG. 4, the RAM 70 is a storage device that temporarily stores, as a buffer before printing, information of patterns to be printed and the aspect ratio of the pattern. The pattern refers to characters, symbols, graphics, and numerals to be printed on the tape 36 and inputted by the user through the input device 22. The aspect ratio refers to the ratio between the size in the horizontal direction and the size in the vertical direction of the pattern to be printed. In this embodiment, the aspect ratio is changed when the printing is performed, taking into account that the user may, in the actual use of the tape 36, stretch the tape 36 in the longitudinal direction thereby contracting the tape 36 in the width direction.

The tape printing unit 80 includes a head drive circuit 81, a roller drive circuit 82, and a cutter drive circuit 83. Here, the tape printing unit 80 corresponds to the printing unit in the present disclosure.

The head drive circuit 81 drives the thermal head 26 so as to generate heat, under the control of the controller 50.

The roller drive circuit 82 drives the platen roller 27 and the ink ribbon take-up drive shaft 31 so as to rotate, according to the motor control performed by the controller 50.

The cutter drive circuit 83 drives the tape cutter 32 under the control of the controller 50.

The groove detection sensor 90 detects the presence of the cassette identification groove 41 and the length of the cassette identification groove 41 when the tape cassette 35 including the tape 36 is mounted in the tape cassette chamber 25, and outputs the detection signal to the controller 50, thereby notifying the controller 50 that the tape cassette 35 including the tape 36, which is elastic, has been detected and that the tape width before expansion is 18 mm. The groove detection sensor 90 serves as a detector.

Regarding the printing apparatus 20 described as above with reference to FIG. 1 to FIG. 6, a distinctive feature is a compression/expansion printing operation that allows a single line of tape 36 having a tape width of 18 mm before expansion to be utilized in a plurality of different tape widths (12 mm and 9 mm in this embodiment) after expansion. Accordingly, the compression/expansion printing operation will be described hereunder, with reference to the flowchart shown in FIG. 7.

Before starting the compression/expansion printing, the user inputs through the input device 22 the information necessary for the printing, such as the pattern to be printed on the tape 36, and the format and the font size of the pattern (font size of the pattern defined when the tape 36 is stretched in the longitudinal direction and contracted in the width direction), and selects the desired tape width after expansion on the menu screen on the display 24. Then when the user presses the print start key on the input device 22, the compression/expansion printing is started. In the description given hereunder, it will be assumed that the user has inputted patterns expressed as "V", "W", "X", "Y", and "Z".

First, the controller 50 acquires the expansion and contraction rate corresponding to the tape width after expansion (step S11: acquisition step). More specifically, the controller 50 looks up the expansion and contraction rate table and acquires the stretch rate in the longitudinal direction and the contraction rate in the width direction corresponding to the tape width after expansion. For example, when the user selects the tape width after expansion of 9 mm, the controller 50 looks up the expansion and contraction rate table and acquires the stretch rate in the longitudinal direction 2 (200%) and the contraction rate in the width direction ½ (50%), each corresponding to the tape width after expansion of 9 mm. Here, the controller 50 may directly receive the input of the expansion and contraction rate (stretch rate in the longitudinal direction and contraction rate in the width direction made by the user.

The controller 50 then determines a compression rate in the longitudinal direction and a stretch rate in the width direction, on the basis of the stretch rate in the longitudinal direction and the contraction rate in the width direction, respectively (step S12: determination step). More specifically, the controller 50 determines the compression rate of the pattern in the longitudinal direction on the basis of the reciprocal of the stretch rate in the longitudinal direction, and the stretch rate of the pattern in the width direction on the basis of the reciprocal of the contraction rate in the width direction.

For example, when the tape width after expansion is 12 mm, the controller 50 determines the compression rate (third expansion and contraction rate) of the pattern in the longitudinal direction as ⅔ (approximately 66.7%) which is the reciprocal of the stretch rate in the longitudinal direction 3/2 (150%), and the stretch rate (fourth expansion and contraction rate) of the pattern in the width direction as 3/2 (150%) which is the reciprocal of the contraction rate in the width direction ⅔ (approximately 66.7%). Likewise, when the tape width after expansion is 9 mm, the controller 50 determines the compression rate in the longitudinal direction as ½ (50%) which is the reciprocal of the stretch rate in the longitudinal direction 2 (200%), and the stretch rate in the width direction as 2 (200%) which is the reciprocal of the contraction rate in the width direction ½(50%). Thus, each of the patterns ("V", "W", "X", "Y", and "Z") is compressed in advance in the longitudinal direction by an amount corresponding to the stretch rate in the longitudinal direction defined when the tape 36 is stretched in the longitudinal direction and contracted in the width direction, and stretched in the width direction by an amount corresponding to the contraction rate in the width direction.

The process at step S12, where the compression rate of the pattern in the longitudinal direction (horizontal direction) and the stretch rate of the pattern in the width direction (vertical direction) are determined, may also be construed as determining the aspect ratio of the pattern to be adopted at the time of the printing. For example, when the compression rate in the longitudinal direction (horizontal direction) is ½ (50%) and the stretch rate in the width direction (vertical direction) is 2 (200%), the aspect ratio of the pattern is determined as vertical 4 to horizontal 1.

Then, the controller 50 instructs the tape printing unit 80 to print indicator marks 39, 39' (first mark 39, second mark 39') simultaneously with the compression/expansion printing (step S13). More specifically, the controller 50 instructs the tape printing unit 80 to print the patterns ("V", "W", "X", "Y", and "Z") which are compressed at the compression rate of the pattern in the longitudinal direction, and stretched at the stretch rate of the pattern in the width direction, on the tape 36 (printing step). In other words, the controller 50 instructs the tape printing unit 80 to print the patterns at the aspect ratio determined on the basis of the compression rate in the longitudinal direction and the stretch rate in the width direction. The font size of the pattern that serves as the base for the compression/expansion printing is the font size supposed to appear on the tape 36 stretched in the longitudinal direction and compressed in the width direction by the user.

Figure 8A:
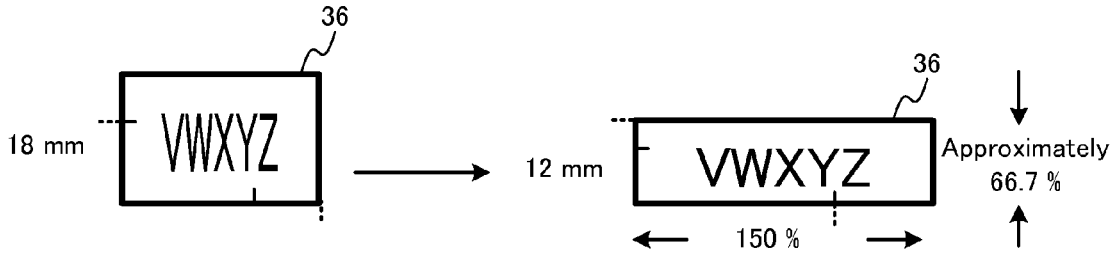
FIG. 8A is a drawing showing the tape with indicator marks, and marks put on an object stick the tape to, in the state where the tape width is 18 mm before expansion (left in the drawing) and where the tape width is contracted from 18 mm before expansion to 12 mm after expansion (right in the drawing)
Figure 8B:
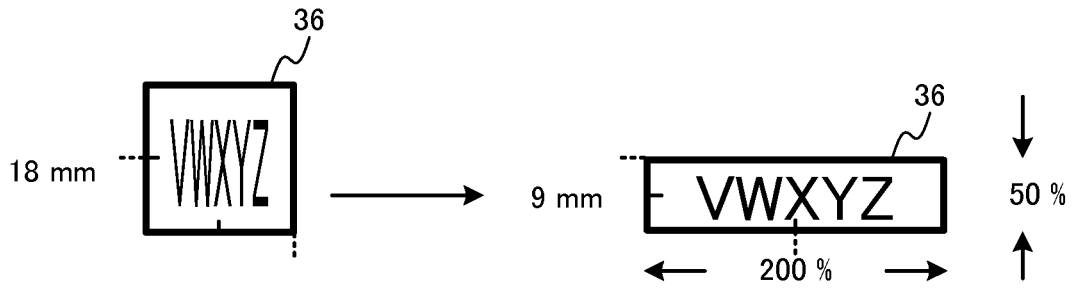
FIG. 8B is a drawing showing the tape with indicator marks, and marks put on the object stick the tape to, in the state where the tape width is 18 mm before expansion (left in the drawing) and where the tape width is contracted from 18 mm before expansion to 9 mm after expansion (right in the drawing)

The controller 50 also instructs the tape printing unit 80 to print, simultaneously with the printing of the patterns, the indicator mark 39 for indicating that the size of the tape 36 in the width direction has been set to the target width when the tape 36 is stretched in the longitudinal direction, and the indicator mark 39' for indicating that the size of the tape 36 in the longitudinal direction has been set to the target length when the tape 36 is contracted in the width direction (mark printing step). Here, FIG. 8A illustrates the tape 36 with the indicator marks 39, 39' printed thereon, in the state before expansion where the tape width is 18 mm (left side in the drawing), and in the state where the tape width has been contracted from 18 mm before expansion to 12 mm after expansion (right side in the drawing). Likewise, FIG. 8B illustrates the tape 36 with the indicator marks 39, 39' printed thereon, in the state before expansion where the tape width is 18 mm (left side in the drawing), and in the state where the tape width has been contracted from 18 mm before expansion to 9 mm after expansion (right side in the drawing). Here, the tape printing unit 80 serves as a printing unit.

The indicator marks 39, 39' in this embodiment are printed at predetermined positions on the tape 36 before expansion, on the basis of the expansion and contraction rate. This aspect will be described in details hereunder, with reference to FIG. 8A.

The side AB extending in the width direction of the tape 36 will be referred to as first side, and the side AC extending in the longitudinal direction will be referred to as second side. The side AB (first side) and the side AC (second side) intersect at the point A. Since the contraction rate in the width direction is ⅔ (approximately 66.7%), the indicator mark 39 is printed as first mark at a first position corresponding to ⅔ from the point A on the side AB (first side) extending in the width direction of the tape 36 having the tape width of 18 mm before expansion, as indicated by a solid line. In addition, since the stretch rate in the longitudinal direction is 3/2 (150%), indicator mark 39' is printed as second mark at a second position corresponding to ⅔ from the point A on the side AC (second side) extending in the longitudinal direction of the tape 36 having the tape width of 18 mm before expansion, as indicated by a solid line. Thus, in the width direction the indicator mark 39 (first mark) is printed at the first position on the basis of the contraction rate, and in the longitudinal direction the indicator mark 39' (second mark) is printed at the second position on the basis of the reciprocal of the stretch rate (compression rate). Here, the indicator mark may be printed only on either of the longitudinal side and the widthwise side of the tape 36.

To describe the compression/expansion printing from the viewpoint of FIG. 8A, the patterns are printed in a size compressed to ⅔ (approximately 66.7%) in the longitudinal direction and stretched to 3/2 (150%) in the width direction, in other words in the aspect ratio of (vertical 3/2 to horizontal ⅔=vertical 9 to horizontal 4), with respect to the font size of the patterns supposed to appear on the tape 36 the width of which is contracted from 18 mm before expansion to 12 mm after expansion. Accordingly, after the printing the tape 36 having the tape width of 18 mm before expansion is obtained as shown in the left region of FIG. 8A, and when the tape 36 having the tape width of 18 mm before expansion is stretched in the longitudinal direction and contracted in the width direction, the tape 36 having the tape width of 12 mm after expansion, on which the patterns ("V", "W", "X", "Y", and "Z") are printed in the font size desired by the user, is obtained as shown in the right region of FIG. 8A.

Figure 7:
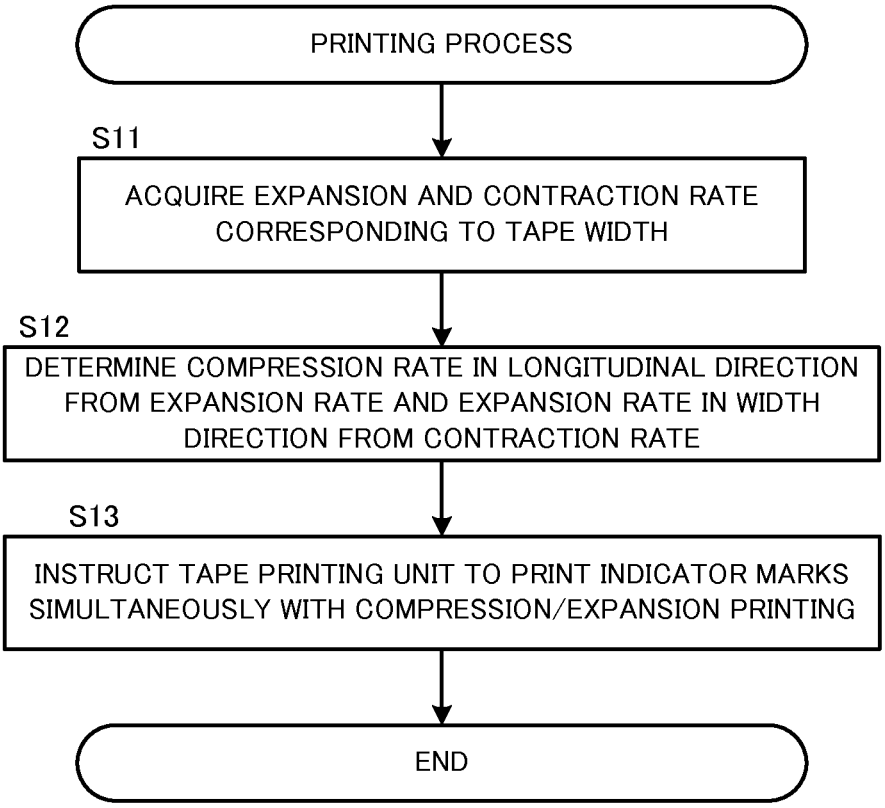
FIG. 7 is a flowchart showing an example of a compression/expansion printing process.

Back to FIG. 7, upon printing the indicator marks 39, 39' simultaneously with the compression/expansion printing (step S13), the compression/expansion printing process is finished. In the compression/expansion printing process, the controller 50 serves as the acquirer and the determiner.

After the printing, the user may put marks 40, 40', for example manually, on an object stick the tape 36 to, as indicated by dot lines in FIG. 8A and FIG. 8B before stretching the tape 36, and then stretch and contract the tape 36 utilizing the indicator marks 39, 39' and the marks 40, 40' as indices, to attach the stretched and contracted tape 36 to the object (attaching step). Here FIG. 8A illustrates the tape 36 with the indicator marks 39, 39', and the marks 40, 40' put on the object, in the state where the tape width is 18 mm before expansion (left in the drawing) and where the tape width is contracted from 18 mm before expansion to 12 mm after expansion (right in the drawing). Likewise, FIG. 8B illustrates the tape 36 with the indicator marks 39, 39', and the marks 40, 40' put on the object, in the state where the tape width is 18 mm before expansion (left in the drawing) and where the tape width is contracted from 18 mm before expansion to 9 mm after expansion (right in the drawing). This aspect will be described in details hereunder, with reference to FIG. 8A.

After the printing, the tape 36 having the tape width of 18 mm before expansion is expanded about a reference point (fixed point) positioned at the corner of the tape 36 corresponding to the point A which is the intersection of the side AB (first side) in the width direction and the side AC (second side) in the longitudinal direction, before the tape 36 is stuck to the object.

(1) First, the mark 40 (first mark) is put on the object at the position corresponding to the first position on the tape 36 having the tape width of 18 mm before expansion where the indicator mark 39 (first mark) is printed on the side AB (first side) extending in the width direction (see left region in the drawing).

(2) The mark 40' (second mark) is put on the object at the position corresponding to a second corner of tape 36 having the tape width of 18 mm before expansion, coinciding with the point C of the side AC (second side) extending in the longitudinal direction (see left region in the drawing).

(3) Then the tape 36 is expanded such that a first corner of the tape 36, coinciding with the point B of the side AB (first side) extending in the width direction of the tape 36, falls on the mark 40 (first mark) on the object, and that the indicator mark 39' (second mark) printed on the side AC (second side) extending in the longitudinal direction of the tape 36 falls on the mark 40' (second mark) on the object (see right region in the drawing).

Through the mentioned process, the user can stretch the tape 36 in the longitudinal direction and contract the tape 36 in the width direction with high accuracy, thereby setting the size of the tape 36 in the width direction to the predetermined width and the size of the tape 36 in the longitudinal direction to the predetermined length. The order of (1) and (2) above may be reversed. In the case where the indicator mark is printed only on either of the longitudinal side and the widthwise side of the tape 36, it suffices to put only the mark corresponding to the indicator mark printed on either of the longitudinal side and the widthwise side, on the object before the expansion of the tape 36.

As described above, in the printing apparatus 20 according to this embodiment, the controller 50 acquires, taking into account that the tape 36 is stretched in the longitudinal direction and contract in the width direction in the actual use, the expansion and contraction rate (stretch rate in the longitudinal direction and contraction rate in the width direction) of the tape 36, determines the aspect ratio of the patterns ("V", "W", "X", "Y", and "Z" in this embodiment) according to the compression rate in the longitudinal direction defined on the basis of the acquired stretch rate in the longitudinal direction and the stretch rate in the width direction defined on the basis of the contraction rate in the width direction, and prints the patterns on the tape 36 in the aspect ratio thus determined.

Therefore, the pattern desired by the user can be obtained upon stretching the tape 36 in the longitudinal direction and contracting in the width direction, and the user can stick the tape 36 set to the tape width after expansion (12 mm or 9 mm in this embodiment) to the object. Such an arrangement enables the single line of tape 36 having the tape width of 18 mm before expansion to be utilized in a plurality of different tape widths after the expansion. Accordingly, the user is exempted from the need to purchase in advance a plurality of tapes of different tape widths to be utilized, and manage the tapes with respect to each of the tape widths. In addition, the user is exempted from the trouble of replacing the tape. Consequently, the trouble incidental to the preparation of the printing, as well as the burden of management on the user can be minimized.

In this embodiment, in addition, the pattern to be printed on the tape 36 before expansion is compressed in the longitudinal direction, because the tape 36 is stretched in the longitudinal direction and contracted in the width direction in the actual use. Therefore, the tape 36 before expansion can be saved, which leads to an extended period of use of the tape 36 before expansion.

Further, in this embodiment the indicator marks 39, 39' are printed on the tape 36 before expansion at the predetermined position according to the expansion and contraction rate of the tape 36, and the user puts the marks 40, 40', for example manually, on the object of the tape 36 before the expansion of the tape 36, so as to expand the tape 36 utilizing the indicator marks 39, 39' and the marks 40, 40' before sticking the tape 36 to the object. Such an arrangement allows the user to accurately recognize whether the size of the tape 36 after expansion in the width direction has been set to the predetermined width, and whether the size of the tape 36 after expansion in the longitudinal direction has been set to the predetermined length, thus enabling the size of the tape 36 after expansion in the width direction to be accurately set to the predetermined width, and the size of the tape 36 after expansion in the longitudinal direction to be accurately set to the predetermined length The embodiment of the present disclosure has been described as above, however it is a matter of course that the specific configuration of the printing apparatus 20 and the details of the printing process shown in FIG. 7 are not limited to the foregoing description.

(Variations)

Figure 9:
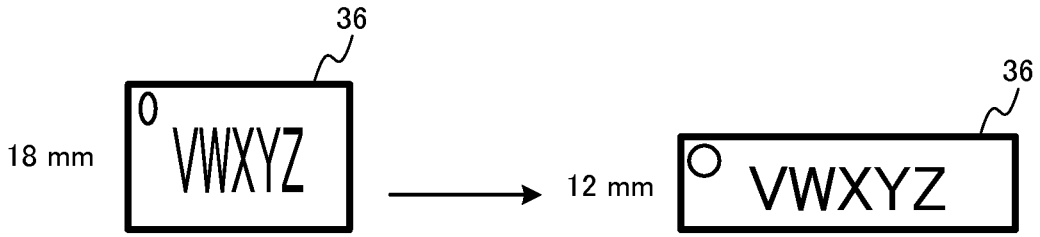
FIG. 9 is a drawing showing a variation of the indicator mark.

Although the indicator marks 39, 39' are printed at the predetermined positions on the basis of the expansion and contraction rate in the printing process shown in FIG. 7, different processes may be adopted. For example, the indicator mark 39 may be printed as shown in FIG. 9. The indicator mark 39 shown in FIG. 9 is a graphic symbol to be set to have an aspect ratio of 1 to 1 when the size of the tape 36 after expansion in the width direction is set to the predetermined width and the size of the tape 36 after expansion in the longitudinal direction is set to the predetermined length.

In the example shown in FIG. 9, the indicator mark 39 of an elliptical shape is printed on the tape 36 having the tape width of 18 mm before expansion, so that the indicator mark 39 turns into a circle having the aspect ratio of 1 to 1 when the tape width is contracted from 18 mm before expansion to 12 mm after expansion. Here, the graphic symbol of different shapes may be adopted, provided that the aspect ratio is set to 1 to 1 when the size of the tape 36 after expansion in the width direction is set to the predetermined width and the size of the tape 36 after expansion in the longitudinal direction is set to the predetermined length. For example, the indicator mark 39 of a rectangular shape may be printed on the tape 36 having the tape width of 18 mm before expansion, so that the indicator mark 39 is turned into a square when the tape width is contracted from 18 mm before expansion to 12 mm after expansion.

In addition, the indicator marks 39, 39' according to the embodiment and variation are provided for the purpose of adjusting the size of the tape 36 after expansion in the width direction to the predetermined width and the size of the tape 36 after expansion in the longitudinal direction to the predetermined length, when the user stretches the tape 36 in the longitudinal direction and contracts in the width direction. Accordingly, it suffices to print the indicator marks 39, 39' so as to allow the user to identify the marks. More specifically, the indicator marks 39, 39' may be faintly and finely printed on the tape 36 before expansion, rather than clearly.

Further, although the indicator marks 39, 39' are printed in the foregoing embodiment and variation, different arrangements may be adopted. In the case where the indicator marks 39, 39' are not provided, the user may set the size of the tape 36 in the width direction to the predetermined width and the size of the tape 36 in the longitudinal direction to the predetermined length, through visual control, for example utilizing as reference the aspect ratio of the pattern obtained when the tape 36 is stretched in the longitudinal direction and contracted in the width direction.

In the foregoing embodiment, further, the description has been given on the premise that the contraction rate in the width direction and the stretch rate in the longitudinal direction of the tape 36 are reciprocal to each other (the area of the tape 36 remains unchanged between before and after the expansion). However, the contraction rate in the width direction and the stretch rate in the longitudinal direction of the tape 36 may be independent from each other, rather than reciprocal to each other (the area of the tape 36 varies between before and after the expansion). In such a case also, it suffices that the contraction rate in the width direction and the stretch rate in the longitudinal direction of the tape 36 are known in advance with respect to the selected tape width after expansion. Further, even when the user designates a tape width not contained in the expansion and contraction rate table as tape width after expansion (tape width other than 12 mm and 9 mm), the controller 50 may obtain the stretch rate in the longitudinal direction and the contraction rate in the width direction, through proportional calculation.

Further, the foregoing embodiment has been described on the premise that the patterns inputted by the user are horizontally written, the patterns may be written in different forms. In the case of vertical writing, for example, the vertically written patterns can be compressed in the longitudinal direction and stretched in the width direction through the same process as FIG. 7, to be printed on the tape 36. In addition, the printed patterns become less dense when the tape 36 is enlarged, and become denser when the tape 36 is contracted. Accordingly, for example when the area of the tape 36 is increased after the expansion, it is preferable to print the patterns with higher density. In contrast, when the area of the tape 36 is reduced after the expansion, it is preferable to print the patterns with lower density.

Still further, although the patterns and printing instructions are inputted through the input device 22 in the embodiment, different methods may be adopted. For example, the printing apparatus 20 may be wiredly or wirelessly connected to a personal computer (PC), so as to input the patterns, select the desired tape width after expansion, or issue the printing instruction, from the printer driver of the PC.

Still further, the embodiment has been described with reference to the elastic tape as example of the print medium, different media may be employed. It suffices that the print medium has elasticity, and the compression/expansion printing may be applied, for example, on an elastic cut sheet. In this case, the printing apparatus 20 may be set up as an ink jet printer or a multifunction peripheral, instead of the tape printer shown in FIG. 1.

Still further, the functions of the printing apparatus 20 according to the present disclosure may be realized by computers such as a popular PC. For example, although the program of the printing apparatus 20 according to the foregoing embodiment is stored in advance in the ROM 60, the program may be recorded on a non-transitory computer-readable recording medium, such as a flexible disk, a compact disc read-only-memory (CD-ROM), a digital versatile disc (DVD), or a magneto-optical disc (MO), and distributed, and a computer capable of realizing the functions of the printing apparatus 20 may be set up by installing the program in the computer.

In addition, the program may be stored in a disk device in a server apparatus on a communication network such as the Internet, so as to allow, for example, a computer to download the program.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

The invention claimed is:

1. A printing apparatus comprising:

a controller that determines an aspect ratio of a printing pattern on a basis of data of an expansion and contraction rate of a continuous print medium to be expandable or contractible after printing on the print medium, the expansion and contraction rate including a first expansion and contraction rate corresponding to a ratio of the length of the print medium after expansion or contraction to the length of the print medium before the expansion or contraction in a longitudinal direction and a second expansion and contraction rate corresponding to a ratio of the length of the print medium after the expansion or contraction to the length of the print medium before the expansion or contraction in a width direction orthogonal to the longitudinal direction; and a printing unit that prints the printing pattern of the aspect ratio determined by the controller, on the print medium before the expansion or contraction.

2. The printing apparatus according to claim 1, wherein the controller determines a third expansion and contraction rate of the printing pattern in the longitudinal direction from a reciprocal of the first expansion and contraction rate, and determines a fourth expansion and contraction rate of the printing pattern in the width direction from a reciprocal of the second expansion and contraction rate, so as to form the printing pattern in the aspect ratio on the print medium after expansion or contraction, and the printing unit prints the printing pattern of the aspect ratio determined on a basis of the fourth expansion and contraction rate and the third expansion and contraction rate, in the longitudinal direction of the print medium.

3. The printing apparatus according to claim 1, wherein the controller determines the aspect ratio of the printing pattern on a basis of the data of the expansion and contraction rate including the second expansion and contraction rate and the first expansion and contraction rate being a reciprocal of the second expansion and contraction rate.

4. The printing apparatus according to claim 1, wherein the printing unit prints, on the print medium before expansion or contraction, a first mark that indicates that a size of the print medium in the longitudinal direction has been set to a length corresponding to the first expansion and contraction rate, and a second mark that indicates that a size of the print medium in the width direction has been set to a width corresponding to the second expansion and contraction rate, in the print medium after expansion or contraction.

5. The printing apparatus according to claim 4, wherein the printing unit prints, on the print medium before expansion or contraction, the first mark at a first position on a first side of the print medium extending in the width direction, and the second mark at a second position on a second side of the print medium extending in the longitudinal direction, and the print medium is expanded or is contracted about a reference point positioned at an end the print medium where the first side and the second side intersect, such that the other end in the width direction coincides with the first position and that the other end in the longitudinal direction coincides with the second position.

6. The printing apparatus according to claim 1, wherein the printing unit prints, on the print medium before expansion or contraction, a graphic symbol to be formed, in the print medium after expansion or contraction, so as to have a ratio of 1 to 1 between a size in the longitudinal direction corresponding to the first expansion and contraction rate and a size in the width direction corresponding to the second expansion and contraction rate of the print medium after expansion or contraction.

7. A printing method comprising:

a controlling step including determining an aspect ratio of a printing pattern on a basis of data of an expansion and contraction rate of a continuous print medium to be expandable or contractible after printing on the print medium, the expansion and contraction rate including a first expansion and contraction rate corresponding to a ratio of the length of the print medium after expansion or contraction to the length of the print medium before the expansion or contraction in a longitudinal direction and a second expansion and contraction rate corresponding to a ratio of the length of the print medium after the expansion or contraction to the length of the print medium before the expansion or contraction in a width direction orthogonal to the longitudinal direction; and a printing step including printing the printing pattern of the aspect ratio determined by the controller, on the print medium before the expansion or contraction.

8. The printing method according to claim 7, wherein the control step includes determining a third expansion and contraction rate of the printing pattern in the longitudinal direction from a reciprocal of the first expansion and contraction rate, and determining a fourth expansion and contraction rate of the printing pattern in the width direction from a reciprocal of the second expansion and contraction rate, so as to form the printing pattern in the aspect ratio on the print medium after expansion or contraction, and the printing step includes printing the printing pattern of the aspect ratio determined on a basis of the fourth expansion and contraction rate and the third expansion and contraction rate, in the longitudinal direction of the print medium.

9. The printing method according to claim 7, wherein the control step includes determining the aspect ratio of the printing pattern on a basis of the data of the expansion and contraction rate including the second expansion and contraction rate and the first expansion and contraction rate being a reciprocal of the second expansion and contraction rate.

10. The printing method according to claim 7, wherein the printing step includes printing, on the print medium before expansion or contraction, a first mark that indicates that a size of the print medium in the longitudinal direction has been set to a length corresponding to the first expansion and contraction rate, and a second mark that indicates that a size of the print medium in the width direction has been set to a width corresponding to the second expansion and contraction rate, in the print medium after expansion.

11. The printing method according to claim 10, wherein the printing step includes printing, on the print medium before expansion or contraction, the first mark at a first position on a first side of the print medium extending in the width direction, and the second mark at a second position on a second side of the print medium extending in the longitudinal direction.

12. The printing method according to claim 11, further comprising an expansion and contraction step including expanding the print medium about a reference point positioned at an end the print medium where the first side and the second side intersect, such that the other end in the width direction coincides with the first position and that the other end in the longitudinal direction coincides with the second position.

13. The printing method according to claim 10, wherein printing step includes printing, on the print medium before expansion or contraction, a graphic symbol to be formed, in the print medium after expansion or contraction, so as to have a ratio of 1 to 1 between a size in the longitudinal direction corresponding to the first expansion and contraction rate and a size in the width direction corresponding to the second expansion and contraction rate of the print medium after expansion or contraction.

14. A computer readable medium storing a printing program configured to cause a computer to:

determine an aspect ratio of a printing pattern on a basis of data of an expansion and contraction rate of a continuous print medium to be expandable or contractible after printing on the print medium, the expansion and contraction rate including a first expansion and contraction rate corresponding to a ratio of the length of the print medium after expansion or contraction to the length of the print medium before the expansion or contraction in a longitudinal direction and a second expansion and contraction rate corresponding to a ratio of the length of the print medium after the expansion or contraction to the length of the print medium before the expansion or contraction in a width direction orthogonal to the longitudinal direction; and print the printing pattern of the aspect ratio determined by the controller, on the print medium before the expansion or contraction.

15. The computer readable medium according to claim 14, configured to cause the computer to:

determine a third expansion and contraction rate of the printing pattern in the longitudinal direction from a reciprocal of the first expansion and contraction rate, and determine a fourth expansion and contraction rate of the printing pattern in the width direction from a reciprocal of the second expansion and contraction rate, so as to form the printing pattern in the aspect ratio on the print medium after expansion or contraction; and print the printing pattern of the aspect ratio determined on a basis of the fourth expansion and contraction rate and the third expansion and contraction rate, in the longitudinal direction of the print medium.

16. The computer readable medium according to claim 14, configured to cause the computer to determine the aspect ratio of the printing pattern on a basis of the data of the expansion and contraction rate including the second expansion and contraction rate and the first expansion and contraction rate being a reciprocal of the second expansion and contraction rate.

17. The computer readable medium according to claim 14, configured to cause the computer to print, in the print medium before expansion or contraction, a first mark that indicates that a size of the print medium in the longitudinal direction has been set to a length corresponding to the first expansion and contraction rate, and a second mark that indicates that a size of the print medium in the width direction has been set to a width corresponding to the second expansion and contraction rate, in the print medium after expansion or contraction.

18. The computer readable medium according to claim 17, configured to cause the computer to print, in the print medium before expansion or contraction, the first mark at a first position on a first side of the print medium extending in the width direction, and the second mark at a second position on a second side of the print medium extending in the longitudinal direction.

19. The computer readable medium according to claim 14, configured to cause the computer to print, in the print medium before expansion or contraction, a graphic symbol to be formed, in the print medium after expansion or contraction, so as to have a ratio of 1 to 1 between a size in the longitudinal direction corresponding to the first expansion and contraction rate and a size in the width direction corresponding to the second expansion and contraction rate in the print medium after expansion or contraction.

* * * * *